US006491105B2

(12) United States Patent
Holt, Jr.

(10) Patent No.: US 6,491,105 B2
(45) Date of Patent: Dec. 10, 2002

(54) CROSS-OVER HOUSING FOR GAS LIFT VALVE

(75) Inventor: James H. Holt, Jr., Conroe, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 40 days.

(21) Appl. No.: 09/803,635

(22) Filed: Mar. 9, 2001

(65) Prior Publication Data

US 2002/0139534 A1 Oct. 3, 2002

Related U.S. Application Data

(63) Continuation-in-part of application No. 09/782,950, filed on Feb. 14, 2001.

(51) Int. Cl.[7] ..... E21B 43/12
(52) U.S. Cl. ..... 166/372; 166/321; 137/55
(58) Field of Search ..... 166/319, 321, 166/372, 242.3; 137/155; 417/109

(56) References Cited

U.S. PATENT DOCUMENTS

| | | | | |
|---|---|---|---|---|
| 3,363,581 A | 1/1968 | Kelley et al. | ..... | 103/232 |
| 4,067,350 A | 1/1978 | Raggio | ..... | 137/155 |
| 4,110,057 A | 8/1978 | McMurry et al. | ..... | 417/109 |
| 4,151,857 A | 5/1979 | DeMoss et al. | ..... | 137/155 |
| 4,295,796 A | 10/1981 | Moore | ..... | 417/115 |
| 4,441,519 A | 4/1984 | Terral | ..... | 137/15 |
| 4,489,743 A | 12/1984 | Canalizo et al. | ..... | 137/155 |
| 4,545,731 A | 10/1985 | Canalizo et al. | ..... | 417/86 |
| 5,066,198 A | 11/1991 | Decker | ..... | 417/54 |
| 5,170,815 A | 12/1992 | Going et al. | ..... | 137/155 |
| 5,522,418 A | 6/1996 | Johnson et al. | ..... | 137/155 |

OTHER PUBLICATIONS

EVI Tools Gas Lift Products & Services Catalog, dated Sep. 1997.

Weatherford Enterra Product Catalog (undated).

ISR for PCT/GB 02/ 00473, dated Jul. 17, 2002.

*Primary Examiner*—David Bagnell
*Assistant Examiner*—Brian Halford
(74) *Attorney, Agent, or Firm*—Moser, Patterson & Sheridan, L.L.P.

(57) ABSTRACT

The present invention provides a cross-over housing for a gas lift valve. In the present invention, the series of radial apertures, or jets, typically utilized within the cross-over housing of a production pressure operated gas lift valve are removed. In their place, a substantially continuous through opening is employed, having an area somewhat greater than the area of the pressure chamber seat. This avoids the occurrence of sonic flow, or critical flow, within the jets of the prior art which hampered the ability of the pressure chamber valve to close. The new configuration for the cross-over housing allows the bellows within the pressure chamber to sense the decrease in production fluid pressure, or tubing pressure, as gas is injected, allowing the pressure chamber valve to be reseated.

6 Claims, 4 Drawing Sheets

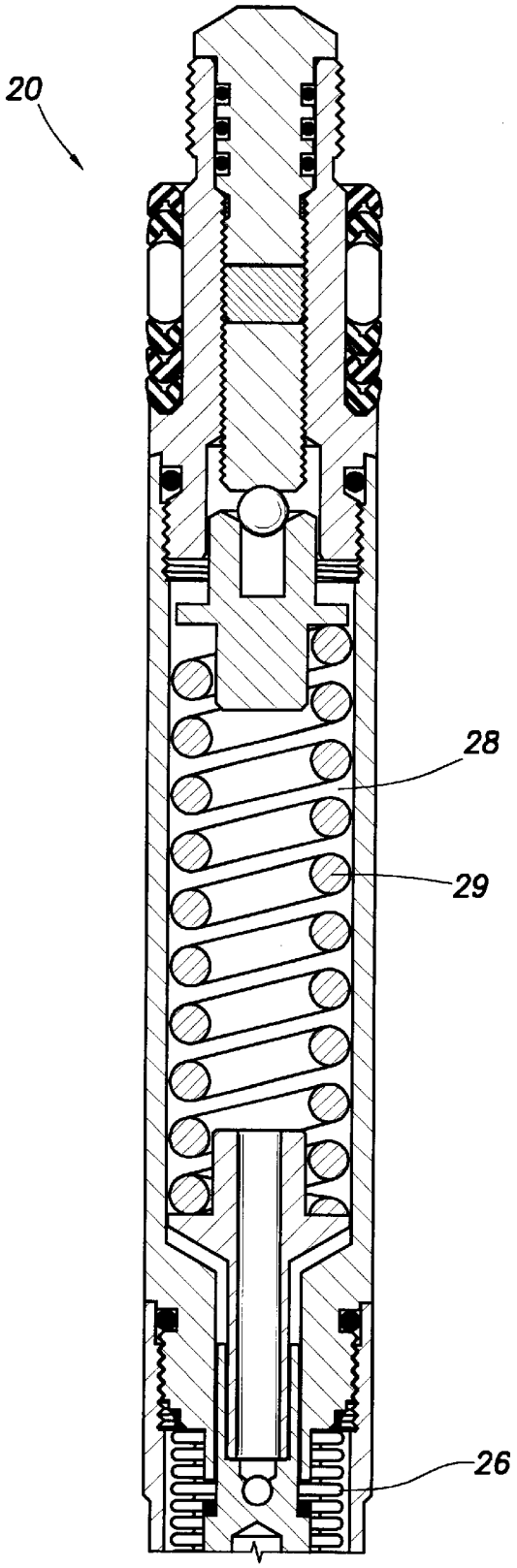
FIG.3a1
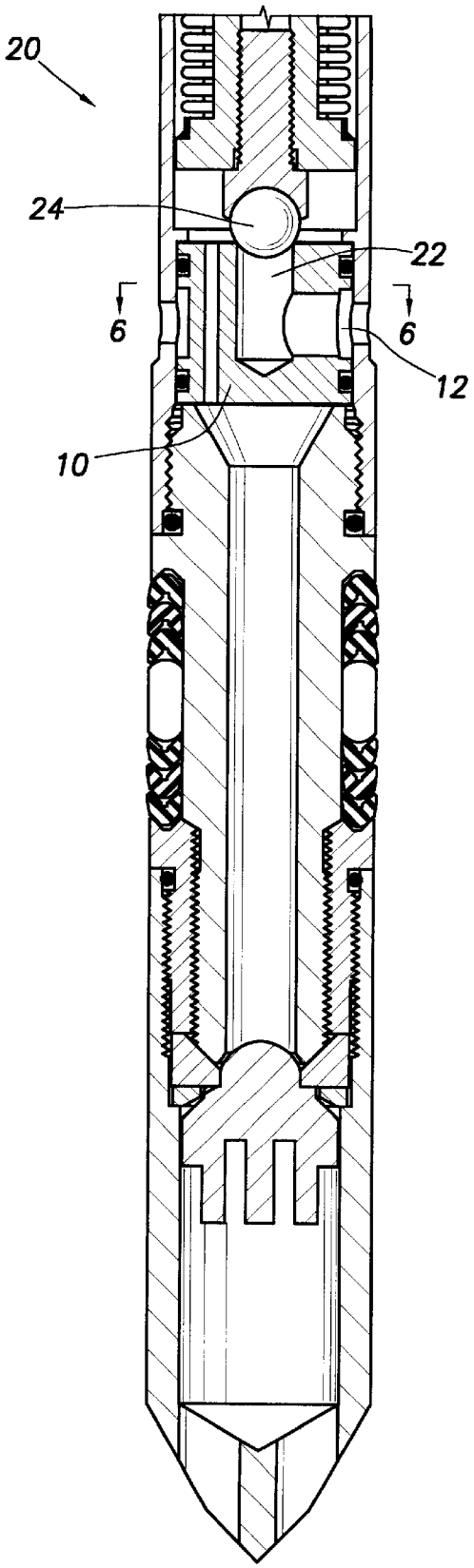
FIG.3a2

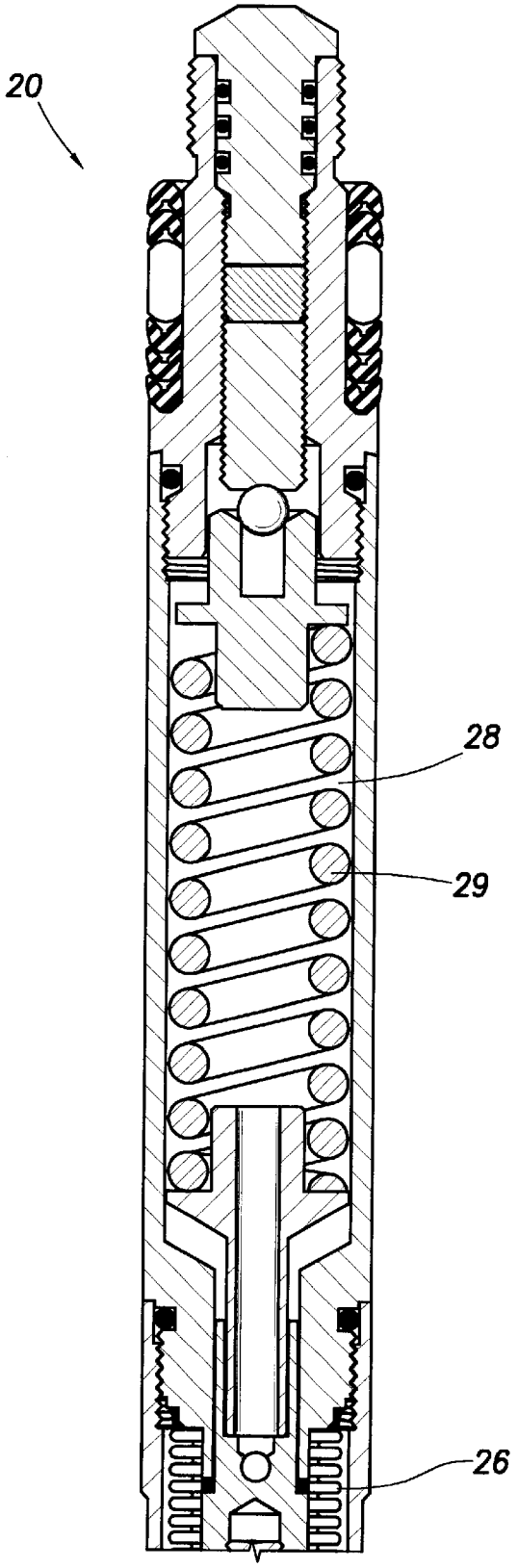
FIG.3b1
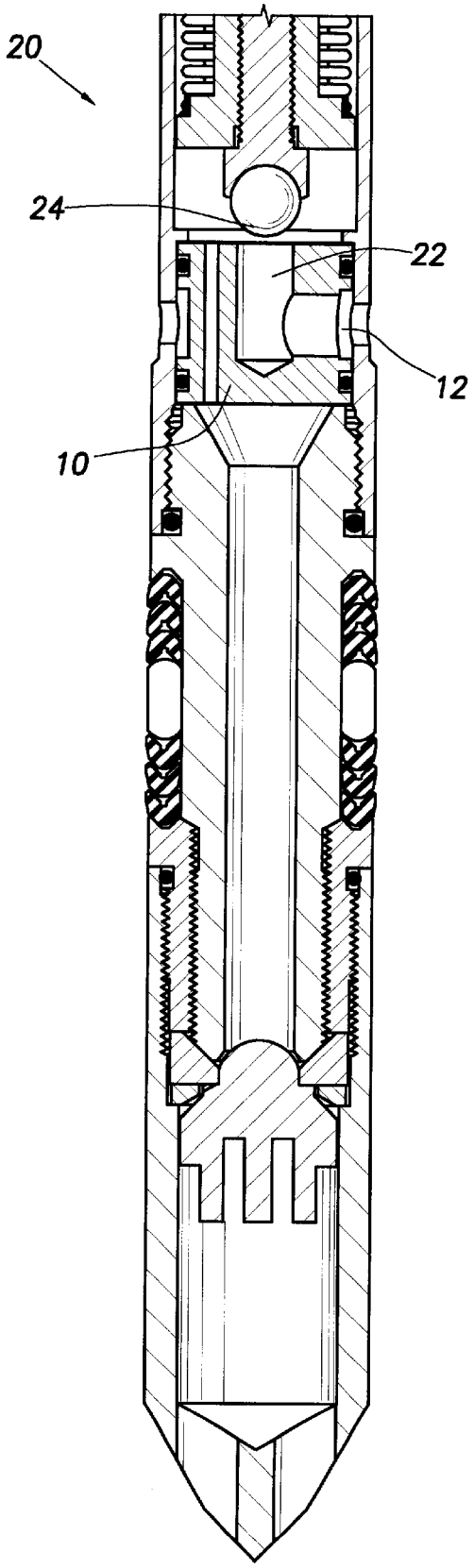
FIG.3b2

CROSS-OVER HOUSING FOR GAS LIFT VALVE

CROSS-REFERENCE TO RELATED APPLICATIONS

This application is a continuation-in-part to the application filed on Feb. 14, 2001, entitled Crossover Housing For Production Pressure Operated Gas Lift Valve. That application was given Ser. No. 09/782,950.

STATEMENT REGARDING FEDERALLY SPONSORED RESEARCH OR DEVELOPMENT

This invention is not the result of federally sponsored research or development, and no government license rights exist as of the time of filing herein.

BACKGROUND OF THE INVENTION

1. Field of the Invention

The present invention relates to artificial lift for hydrocarbon wells. More particularly, the invention relates to an improved housing for a production pressure operated gas lift valve.

2. Background of the Related Art

The production of fluid hydrocarbons from wells involves technologies that vary depending upon the characteristics of the well. While some wells are capable of producing under naturally induced reservoir pressures, more common are wells which employ some form of an artificial lift production procedure, During the life of any producing well, the natural reservoir pressure decreases as gases and liquids are removed from the formation. As the natural formation pressure of a well decreases, the hydrostatic pressure from fluid within the production tubing becomes greater than the formation pressure, thereby inhibiting the flow of hydrocarbons from the formation to the surface. This phenomenon may also occur naturally in deep wells that encounter flow resistance from the substantial hydrostatic head.

In such wells, it is conventional to periodically remove the accumulated liquids by artificial lift techniques. One such technique which has been know for many years involves the use of gas lift devices.

Gas lift is a method of producing hydrocarbons by which gas is injected through a pressure-sensitive valve into the tubing. One or more valves are placed at or above the production zone. In operation, gas under pressure is injected into the annular space between casing and tubing above the production packer. The pressurized gas is delivered from the gas lift valve and into the tubing. Fluid that is in the tubing above the gas injection port is displaced, lightened by mixing with the gas, and is raised to the surface by the expanding gas.

The gas lift process closely simulates the natural flow process but provides a highly economical enhancement of that process. When natural gas is produced with oil or is available from nearby wells from injection, gas lift becomes an economical means for enhancing the hydrocarbon recovery from an oil well.

Some gas lift valves are tubing-retrievable, meaning they are placed between joints of the tubing string and are pulled along with the tubing. Other gas lift valves are wireline retrievable. Such valves are run in side pocket mandrels and pulled and replaced by means of a wire line unit. Wireline retrievable gas lift valves are typically configured between joints of the tubing string.

Over the years, gas lift valves have been designed which operate based upon different pressure sources. One common valve is the production-pressure operated (PPO) gas lift valve. In this arrangement, pressure from inside of the tubing provides the primary pressure source for operation of the gas lift valve. Hydrostatic pressure of fluid within the tubing, coupled also with pressure from the producing formation causes fluids from the tubing to enter the pressure chamber within the gas lift valve. At the same time, pressure from gas injected into the tubing-casing annulus is also forced into the pressure chamber via a separate through-opening. Together, these fluids act upon a bellows within the pressure chamber, above a ball and seat valve.

The bellows is spring-biased or gas-charged to hold the pressure chamber valve in a closed position. However, when a preset level of pressure is reached, the bellows contracts, lifting the valve stem and ball off the seat. Fluids acting upon the bellows are then expelled from the gas lift valve into the tubing. In this manner, the hydrostatic head within the tubing is lightened.

The typical seat for a production pressure operated gas lift valve resides on a housing known as a cross-over housing. In this embodiment, production fluid and casing gas both enter the pressure chamber of the gas lift valve through the cross-over housing. The production fluid and the casing gas cross paths through the housing, but do not commingle within the housing; hence, the name. Production fluids enter the cross-over housing via a series of radial apertures, or jets, machined longitudinally into the housing. Casing gas enters the housing via one or more elbow-shaped through- openings which places the annulus and the seat of the cross-over housing in direct fluid communication. In this manner, formation fluids apply pressure on the bellows, while casing gas acts directly on the seat under the ball of the valve.

At some preset point, the combined pressure from the formation fluids and the casing gas will unseat the pressure chamber valve. When this occurs, the formation fluid commingles with the injected gas from the casing within the pressure chamber. When the production pressure overcomes the preset charge or spring force of the bellows assembly, the bellows is compressed and the valve stem and ball is lifted off the valve seat, opening the pressure chamber valve. Because the casing gas is maintained at a pressure greater than that of the formation, the formation fluid is expelled back through the cross-over housing jets. This means that formation fluids, commingled with casing gas, make a 180 degree turn, exiting the pressure chamber through the jets. The pressure on the bellows within the pressure chamber then drops, causing the valve to reseat.

It has been discovered that an operational problem sometimes arises with respect to the reseating of the pressure chamber valve. In some instances, the bellows is unable to recognize a pressure drop within the pressure chamber after the valve is unseated. Analysis of this phenomenon reveals that the configuration of the jets sometimes restricts the ability of the tubing pressure to be sensed above the cross-over housing. In this regard, sonic flow, or critical flow, is created within the crossover configuration of the housing such that the pressure on the bellows remains at a level sufficient to the keep the pressure chamber valve unseated. This, in turn, causes continuous injection of gas into the production string, thereby inhibiting hydrocarbon production.

It is, therefore, an object of the present invention to provide a gas lift valve wherein the pressure chamber valve closes properly after being unseated, thereby injecting gas into the production string intermittently.

It is a further object of the present invention to provide a configuration for a cross-over housing within a production pressure operated gas lift valve which facilitates the egress of casing gas from the pressure chamber after the pressure chamber valve has been unseated.

Yet another object of the present invention is to replace the series of radial apertures within the seat housing of a production pressure operated gas lift valve with a substantially continuous through-opening.

Still further, an object of the present invention is to provide a substantially continuous aperture within the cross-over housing for a production pressure operated gas lift valve, whereby the substantially continuous aperture permits an increased volume of gas to flow through the cross-over housing without reaching critical flow so that the bellows can sense a pressure drop, thus allowing the pressure chamber valve to be reseated.

And another object of the present invention is to provide a more efficient production pressure operated gas lift valve having an improved cross-over housing capable of being utilized in both top and bottom latch gas lift valves.

Finally, an object of the present invention is to provide a cross-over housing for a gas lift valve which is easier to machine and more economical to produce.

SUMMARY OF THE INVENTION

The present invention provides a more efficient gas lift valve by presenting an improved cross-over housing. In the present invention, the series of radial apertures, or jets, typically utilized within the cross-over housing of a production pressure operated gas lift valve are removed. In their place is a substantially continuous, arcuate aperture. The aperture will also have an area significantly greater than the area of the casing gas through-opening, or seat. This allows the bellows within the pressure chamber of the gas lift valve to sense the eventual pressure drop of tubing pressure which occurs during gas injection. This, in turn, allows the pressure chamber valve to be reseated.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 3(*a*)(1)–(2) is a cross-sectional view of a production pressure operated gas lift valve having a top latch, and showing the pressure chamber valve in a closed position.

FIG. 3(*b*)(1)–(2) is a cross-sectional view of a production pressure operated gas lift valve having a top latch, and showing the pressure chamber valve in an open position.

DETAILED DESCRIPTION OF THE PREFERRED EMBODIMENT

Figure 1:
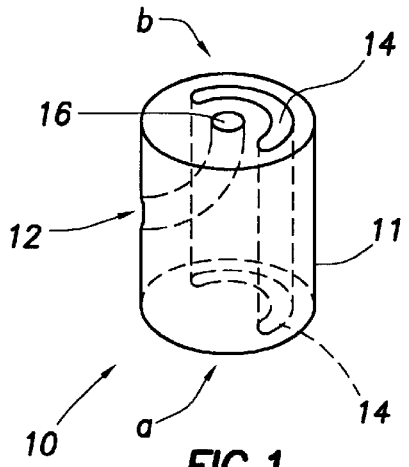
FIG. 1 is a perspective view of the cross-over housing of the present invention, as utilized for production pressure operated gas lift valves.

FIG. 1 is a perspective view of the cross-over housing 10 of the present invention. This cross-over housing has application in gas lift valves 20 of the class which are production pressure operated, such as the McMurry-Macco™ RF-1, RF-2, RF-1 BL and RF-1 A Gas Lift Valves. The placement of the cross-over housing 10 within the gas lift valve 20 is depicted in FIGS. 3(*a*), 3(*b*) and 4.

Gas lift itself involves the injection of pressurized gas into the production string (not shown) of a hydrocarbon producing well (also not shown). Gas lift is typically employed where the native reservoir energy of the formation producing into the well is sufficiently low that there is not enough pressure within the formation to force fluids in the well to the surface. In other wells in which there is sufficient reservoir pressure to force fluids to the surface, injection gases may often be used to increase the production from the well. The casing gas is maintained at a pressure higher than the reservoir pressure, typically 800 to 1200 psi. The pressurized gas is injected down the annulus between the outside well-bore casing and the inner production tubing string (not depicted) and introduced into the base of the fluid column in the tubing string via specialized downhole gas lift valves. The effect is to 'aerate' the hydrostatic head within a well (not shown), reducing its density and causing the resultant gas/oil mixture to flow up the tubing.

Figure 4A:
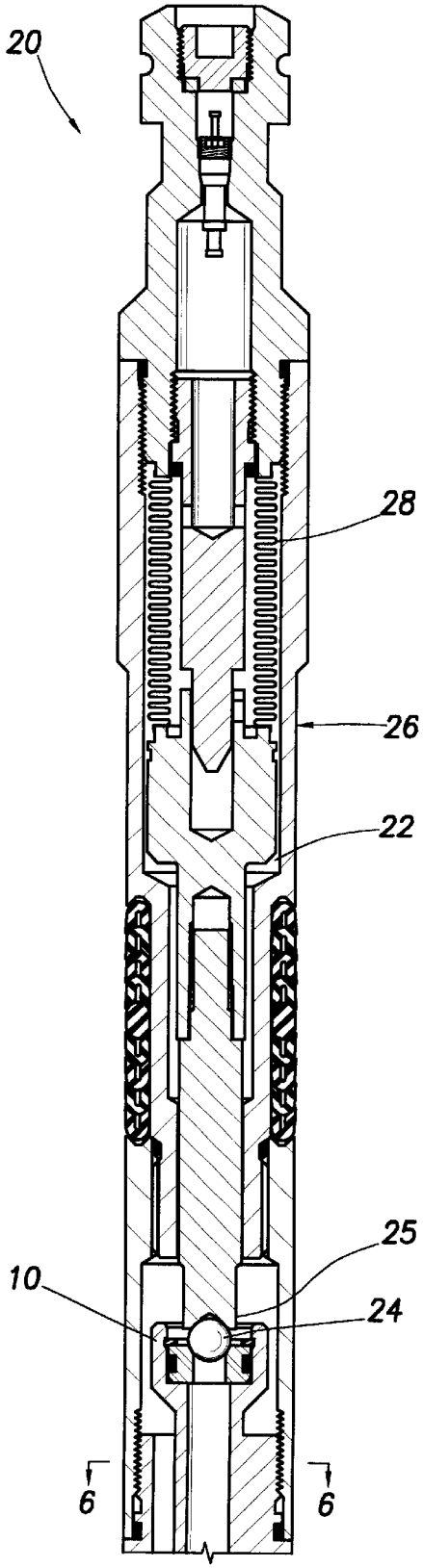
FIG. 4(*a*)–(*b*) is a cross-sectional view of a production pressure operated gas lift valve having a bottom latch, and showing the pressure chamber valve in a closed position.
Figure 4B:
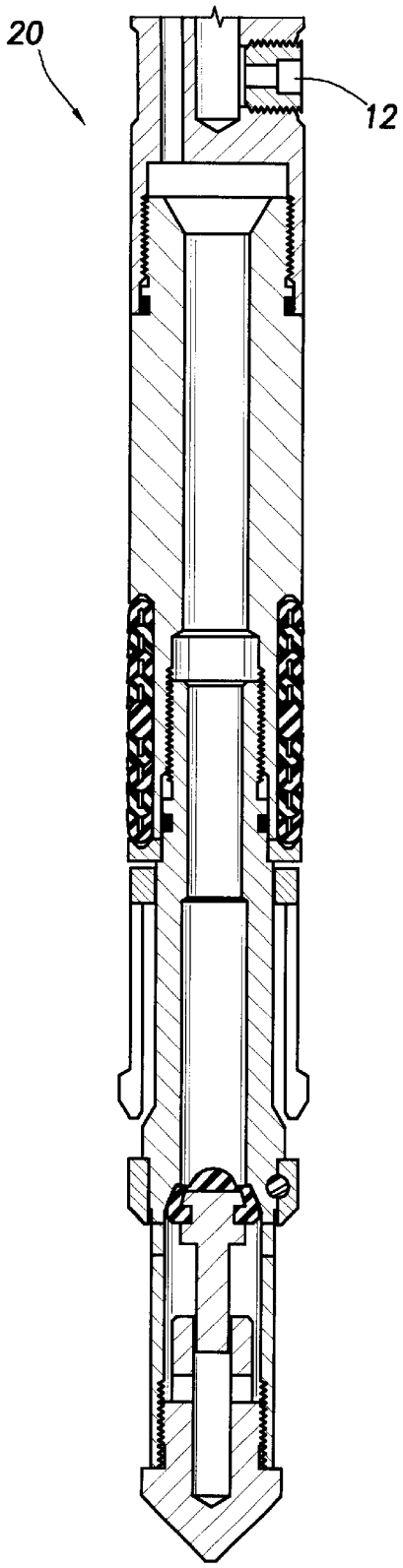

Each gas lift valve 20 has a "set pressure" which is established by a pressure chamber 26 within the valve 20. The production pressure operated gas lift valve 20 utilizes a bellows 28 which acts to exert a force tending to close the pressure chamber valve 24. In some embodiments, the bellows is filled with compressed nitrogen to a preselected pressure value. Such an embodiment is shown in FIG. 4(*a*)–(*b*), with FIG. 4(*a*)–(*b*) depicting a cross-sectional view of a bottom latch gas lift valve. However, in most instances, and in the embodiments shown in FIGS. 3(*a*)(1)–(2) and 3(*b*)(1)–(2), the bellows 28 operates through a compressed spring 29 which provides the force necessary to maintain the pressure chamber valve 24 in a normally closed position. This stem-and-ball type valve is thus biased towards closure, or seating. In FIGS. 3(*a*) and 4, the pressure chamber valve 24 is in the closed position.

In a production pressure operated gas lift valve, the production pressure from the tubing acts against the force of the spring 29 of the bellows 28 within the pressure chamber 26. The bellows 28 serves as an area for the tubing pressure to act on as the opening force. The pressure from the tubing applies a force opposite to that of the set pressure of the bellows 28, tending to open the pressure chamber valve 24. When the tubing pressure becomes greater than the preset spring force of the bellows 28 (due to the accumulation of a column of fluid in the tubing) it will cause the valve 24 within the pressure chamber 26 to move upwardly and unseat. The pressure chamber valve 24 will then open. This enables pressurized gas from within the casing (not shown) to be injected into the pressure chamber 26, and then to be expelled into the production tubing. In this manner, fluids which have collected in the tubing above the gas lift valve 20 will be lightened and lifted toward the surface and then discharged for downstream use. FIG. 3(*b*) depicts a gas lift valve 20 wherein the pressure chamber valve 24 is in the opened position.

The gas lift valve 20 operates to inject gas from the casing into the tubing to aerate fluids above the region of the production formation of the well and allow the free flow of fluids from the formation into the well and to the surface. The use of gas lift valves in a well completion allows for the use of relatively low injection pressures at the surface in order to overcome very high tubing pressures at great depths within the well, e.g., 9,000–10,000 feet.

Figure 2:
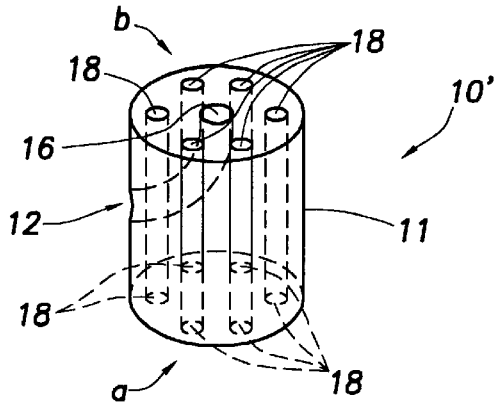
FIG. 2 (PRIOR ART)
FIG. 2 is a perspective view of the cross-over housing found in the prior art, as utilized for production pressure operated gas lift valves.

In the cross-over housing of the prior art 10', shown in FIG. 2, formation fluids enter the pressure chamber 26 through a series of radial apertures machined longitudinally within the cross-over housing 10'. These apertures are known as jets 18. The jets 18 enter the cross-over housing 10' at a lower end a, and then travel into the pressure chamber at an upper end b. At the same time, pressurized gas from the casing acts against the pressure chamber valve 24 through the cross-over housing aperture 12. When the pressure chamber valve 24 is unseated, that is, lifted from the seat 25, production fluids commingle with casing gas. The casing gas is at a higher pressure than the production fluid, causing the casing gas to then exit the pressure chamber 26, exit the gas lift valve 20, and then enter the tubing. In this manner, formation fluids commingled with casing gas make a 180 degree turn, exiting the pressure chamber 26 through the jets 18 and the seat 25.

Eventually, the stream of injected gas will reduce the density of the hydrostatic head within the production string, allowing formation fluids to exit the production string to the surface. The lightened hydrostatic head results in less production fluid pressure being applied to the bellows 26 within the gas lift valve 20. The bellows 26 will sense this pressure reduction and cause the pressure chamber valve 24 to reseat onto the valve port 25.

Figure 5:
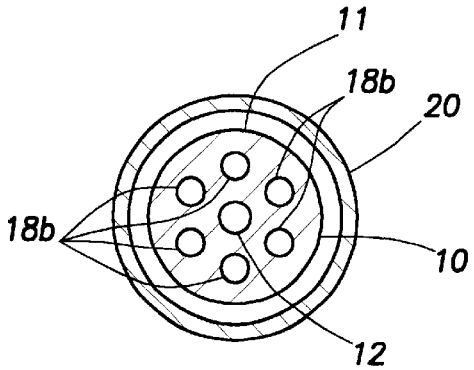
FIG. 5 (PRIOR ART)
FIG. 5 is a cross-sectional view of the cross-over housing of the prior art in plan view.

As discussed above, an operational problem sometimes arises with respect to the reseating of the pressure chamber valve 24. In some instances, the bellows 28 is unable to recognize a pressure drop within the pressure chamber 26. Analysis of this phenomenon reveals that the configuration of the jets 18 sometimes restricts the ability of the gas to pass through the pressure chamber 26 properly. It can be seen from the prior art drawing of FIG. 5 that the jets 18 limit the flow of gas due to their constricted configuration. Moreover, when the housing 10 is built for a larger orifice, the injected casing gas pressure does not see near the pressure drop across the seat 25, thus the area downstream the seat 25 is closer to the casing gas pressure and the valve is wider open. As casing gas flows through the plurality of drilled holes 18 a larger drop is created. Since the seat size 25 is approaching the area of the drilled holes 18, sonic flow is created at the exit point of the drilled holes. Those of ordinary skill in the art will understand that sonic flow, sometimes referred to as choked flow or critical flow, relates to the maximum flow rate of gas through an opening. This rate is a function of upstream vs. downstream pressure, as well as the area of the opening.

The pressure chamber valve 24 is designed to close on a reduction in production fluid pressure, or tubing pressure. When sonic flow is in process, a reduced production fluid pressure cannot penetrate through the sonic jet stream at the exit point of the jets 18; therefore, production fluid pressure cannot reach the bellows 28. The bellows 28 needs to see reduced production fluid pressure to allow the pressure chamber valve 24 to close. Thus, the configuration of a cross-over housing 10' having a plurality of jets 18 can actually inhibit the efficient closure of the pressure chamber valve 24.

Figure 6:
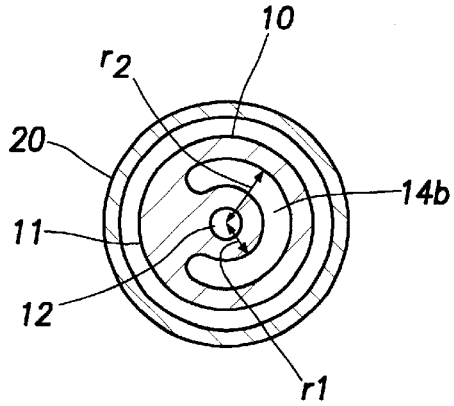
FIG. 6 is a cross-sectional view of the cross-over housing of the present invention, taken substantially in the plane of line 6—6 from FIG. 3(*a*)(1)–(2), FIG. 3(*b*)(1)–(2) and FIG. 4(*a*)–(*b*).
Figure 7:
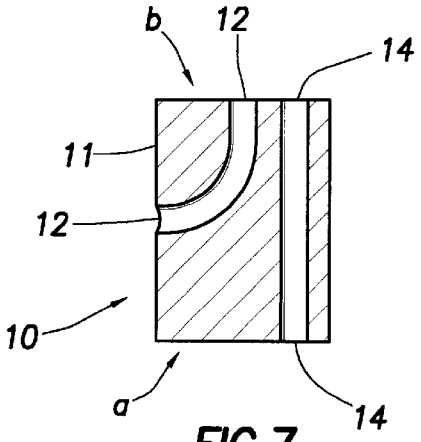
FIG. 7 is a longitudinal cross-sectional view of the cross-over housing of the present invention.

To overcome this problem, the present invention presents a novel cross-over housing 10 wherein the jets 18 are removed. In their place, a substantially continuous semi-circular production fluid aperture 14 is machined into the cross-over housing 10. The production fluid aperture 14 extends lengthwise through the cross-over housing 10, as shown in the cross-sectional view of FIG. 7. As can be seen from the depiction of the production fluid aperture 14 in FIG. 1 and FIG. 6, the area of the novel production fluid aperture 14 is greater than that of the jets 18 of the prior art, and is greater than the area of the seat 25. Further, the configuration of the production fluid aperture 14 of the present invention is not significantly interrupted by the cross-over housing 10 itself, but defines a substantially continuous open aperture 14 so as not to create a barrier to the through-flow of production fluid from the pressure chamber 26. This allows the bellows 28 to sense the pressure drop caused by the lightening of the hydrostatic head during gas injection.

Figure 8:
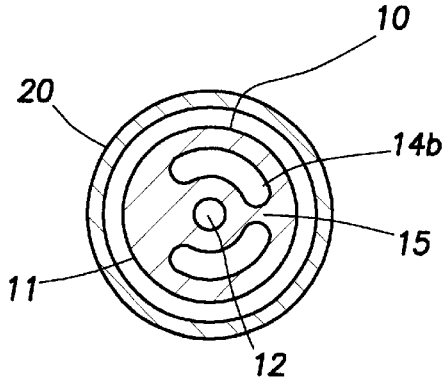
FIG. 8 is a cross-sectional view of the cross-over housing of the present invention in an alternate embodiment, taken substantially in the plane of line 6-6 from FIG. 3(*a*)(1)–(2), FIG. 3(*b*)(1)–(2) and FIG. 4(*a*)–(*b*).

In its preferred embodiment, the production fluid aperture 14 of the present invention is a single arcuate through-opening defining an angular geometrical shape of approximately 250 degrees. However, those skilled in the art will appreciate that the angular dimension of the aperture 14 may be greater than or even less than 250 degrees, so long as the area defined by the aperture 14 remains substantially greater than the area of the valve port 25. Further, those skilled in the art will understand that the production fluid aperture 14 may be of a different shape, or comprise more than one through-opening, as is shown in FIG. 8, so long as the total area of the aperture 14 is of sufficiently greater area than that of the casing gas through opening, or seat 25. In this respect, the use of a production fluid aperture 14 having an intermittent wall 15 enhances the structural integrity of the cross-over housing 10 without compromising the efficiency of the aperture 14 in transporting production fluid and casing gas therethrough.

In a larger cross-over housing 10, the diameter of the seat 25 may be as much as 0.250 inches (0.635 cm.). This means that the total area for fluid flow through the valve port is approximately 0.049 in.$^2$ or 0.317 cm$^2$. This figure is calculated as follows:

$$A = \left(\pi \times \left(\frac{1}{2}d\right)^2\right) = (\pi \times r^2)$$
$$= \pi \times (0.125)^2)$$
$$= 0.049 \text{ in.}^2 \text{ or } 0.317 \text{ cm}^2$$

Thus, in the preferred embodiment, a total area of greater than approximately 0.049 in.$^2$ (0.317 cm$^2$) should be manifested in the aperture 14 of the present invention, in a substantially continuous configuration.

The area of the aperture 14 of the present invention in its preferred embodiment can be approximated by the following formula:

$$A=250°[(\pi\times r_2^2)-(\pi-r_1^2)]=(250°/360°)\times[(\pi\times(0.353)^2)-(\pi\times$$

$(0.183)^2)]=0.694[0.3915-0.1052]=0.199$ in.$^2$ or 1.283 cm$^2$ where $r_2$ is the outer radius of aperture 14, and $r_1$ is the inner radius of aperture 14, and where the angular dimension of the aperture 14 is 250°.

By way of contrast, one might compare the area of 0.199 in.$^2$ of the production fluid aperture 14 of the present invention, with the cumulative area of the jets 18 from the prior art. For a gas lift valve 20 having a valve port 25 size of 0.250 inches (0.635 cm.) in diameter, a jet 18 size of 0.1875 inches (0.48 cm) in diameter is used, such as in the McMurry-Macco RF-1 BL Gas Lift Valve. Further, a total of five jets are used. The prior art area can then be computed as follows:

$$A = 5\times\left(\pi\times\left(\frac{1}{2}d\right)^2\right) = (\pi\times r^2)$$
$$= 5\times[\pi\times(0.09375)^2)]$$
$$= 0.138 \text{ in.}^2 \text{ or } 0.890 \text{ cm}^2$$

Thus, one can quickly see that a production fluid aperture 14 having a greater area has been provided by the new invention, inasmuch as 0.199 in.$^2$ (1.283 cm$^2$) is greater than 0.138 in.$^2$ (0.890 cm$^2$). Further, in the preferred embodiment, the area of the production fluid through opening 14 is more than four times greater than the area of the casing gas through opening 25, comparing 0.199 in.$^2$ (1.283 cm$^2$) to 0.049 in.$^2$ (0.317 cm$^2$). However, the cross-over housing 10 of the present invention may embody a ratio of only 3:1 to be efficient where a substantially continuous configuration is employed in lieu of five separate jets.

While the foregoing is directed to the preferred embodiment of the present invention, other and further embodiments of the invention may be devised without departing from the basic scope thereof, and the scope thereof is determined by the claims that follow. Those skilled in the art will recognize that the given radii and angular dimension of the production fluid aperture 14 may vary, and the above example simply presents a preferred embodiment. The radii and angular dimension of the production fluid aperture 14 may increase so long as the structural integrity of the cross-over housing 10 and its side wall 11 are not compromised, or may even decrease, so long as the area of the aperture 14 is of sufficient size to avoid critical flow by the gas when the pressure chamber valve 24 is unseated.

What is claimed is:

1. A cross-over housing for a production pressure operated gas lift valve for controlling the through-flow of production fluids and casing gas, the gas lift valve having a pressure chamber and a pressure chamber valve, the cross-over housing comprising:

a side wall, a lower surface area and an upper surface area;

a casing gas through-opening providing fluid communication between said side wall and said upper surface for receiving pressurized casing gas; and a substantially continuous production fluid through-opening for providing fluid communication between said lower surface area and said upper surface area, said through opening having a geometric configuration wherein the area of said production fluid though-opening is of sufficient size so as to avoid critical flow of gas when the pressure chamber valve is unseated, thereby permitting the gas lift valve to sense the pressure drop in the tubing, and thereby allow the gas lift valve to reseat.

2. The cross-over housing of claim 1 wherein said production fluid through opening is essentially arcuate in configuration.

3. The cross-over housing of claim 1 wherein the angle of said arcuate configuration of said production fluid through opening is approximately 250°.

4. The cross-over housing of claim 1 wherein the ratio of said area of said production fluid through opening at said upper surface to said area of said casing gas through opening at said upper surface is at least 3:1.

5. The cross-over housing of claim 4 wherein said area of said casing gas through opening at said upper surface is approximately 0.049 in.$^2$, and said area of said production fluid through opening at said upper surface is approximately 0.199 in.$^2$.

6. The cross-over housing of claim 1 wherein said substantially continuous production fluid through-opening defines a single aperture.

* * * * *

UNITED STATES PATENT AND TRADEMARK OFFICE

CERTIFICATE OF CORRECTION

PATENT NO. : 6,491,105 B2 
DATED : December 10, 2002
INVENTOR(S) : James H. Holt, Jr.

It is certified that error appears in the above-identified patent and that said Letters Patent is hereby corrected as shown below:

Title page,
Item [57], ABSTRACT,
Line 1, please change "provides a cross-over" to -- provides an improved cross-over --.

Signed and Sealed this

Twentieth Day of May, 2003

JAMES E. ROGAN
*Director of the United States Patent and Trademark Office*